US005308379A

United States Patent [19]

Ishida et al.

[11] Patent Number: 5,308,379

[45] Date of Patent: May 3, 1994

[54] EXTRA-LOW-OXYGEN COPPER AND A METHOD OF PROCESSING SAME

[75] Inventors: Norikazu Ishida, Saitama; Takurou Iwamura, Chiyoda, both of Japan

[73] Assignee: Mitsubishi Materials Corporation, Ohtemachi, Japan

[21] Appl. No.: 46,250

[22] Filed: Apr. 8, 1993

[30] Foreign Application Priority Data

Apr. 9, 1992 [JP] Japan ..... 4-117022

[51] Int. Cl.[5] ..... C22B 15/00

[52] U.S. Cl. ..... 75/646

[58] Field of Search ..... 75/646

[56] References Cited

U.S. PATENT DOCUMENTS 3,844,772 10/1974 Sherman ..... 75/646

*Primary Examiner*—Peter D. Rosenberg

*Attorney, Agent, or Firm*—Vineet Kohli

[57] ABSTRACT

Copper oxide is added to molten copper to produce an extra-low-oxygen copper having an oxygen concentration of at most 0.5 ppm. In some embodiments, the copper oxide is added as a powder introduced into the melt with a blowing gas. In other embodiments, the molten copper is in contact with graphite during deoxidation and the addition of copper oxide.

18 Claims, No Drawings

EXTRA-LOW-OXYGEN COPPER AND A METHOD OF PROCESSING SAME

BACKGROUND OF THE INVENTION

The present invention relates to a method of manufacturing extra-low-oxygen copper having an oxygen concentration less than or equal to 0.5 ppm and a purity of at least Cu: 99.998 wt. %.

Prior art methods of manufacturing oxygen-free copper include degassing ordinary electrolytic copper through vacuum melting and degassing ordinary electrolytic copper by melting it in an inert gas or reducing gas atmosphere and stirring the molten copper while blowing an inert gas or a reducing gas into it.

The oxygen concentration of the oxygen-free copper manufactured by any of these conventional methods can only be reduced to 1 ppm, and it has been difficult to reduce it below 1 ppm.

Recently, oxygen-free copper is being used as a material for a vacuum vessel, such as an accelerator. Use of a conventional vacuum vessel made of oxygen-free copper under a high vacuum has caused gases, mainly hydrogen gas, remaining in the oxygen-free copper to be released. Thus, the degree of vacuum in the vacuum vessel is reduced. To avoid reduction of the degree of vacuum, it is conventional practice to remove hydrogen gas contained in the conventional oxygen-free copper by baking it. Then, the baked oxygen-free copper is used in a vacuum vessel, such as in an accelerator.

However, even when baking is used to remove hydrogen gas, it can be difficult to remove the hydrogen. Baking is insufficient to remove the hydrogen when oxygen is contained in the oxygen-free copper at a high concentration, since the remaining hydrogen gas is trapped by oxygen gas contained in the oxygen-free copper. When a vacuum vessel made of oxygen-free copper, dehydrogenated by baking, is used under a high vacuum, hydrogen gas released during use makes it impossible to maintain a high degree of vacuum. As a result, there is an increasing demand for an extra-low-oxygen copper having an oxygen concentration lower than what is currently available.

SUMMARY OF THE INVENTION

Accordingly, it is an object of the invention to overcome the drawbacks of the prior art.

It is a further object of the invention to produce an extra-low-oxygen copper having an oxygen concentration lower than that currently available.

The inventors have discovered that adding copper oxide to molten copper during the process of melting and deoxidizing raw material copper gives an oxygen concentration within a range of from 50 to 200 ppm relative to molten copper for a portion of a period of deoxidation. The oxygen concentration in the molten copper finally produced by the process is reduced to below 0.5 ppm. Thus, the present invention produces an extra-low-oxygen copper.

According to an embodiment of the invention, there is provided a method of manufacturing extra-low-oxygen copper comprising: deoxidizing a molten copper, adding a copper oxide to the molten copper to produce a mixture, the copper oxide producing an oxygen concentration within a range of from 50 to 200 ppm relative to the molten copper for a portion of the deoxidizing, and maintaining the mixture at a predetermined melting temperature for a predetermined time.

According to a feature of the invention, there is provided a method of manufacturing extra-low-oxygen copper comprising: melting a copper raw material into a molten copper, deoxidizing the copper raw material, and the step of deoxidizing including creating an oxygen concentration within a range of from 50 to 200 ppm relative to the molten copper during a portion of the deoxidizing.

According to another feature of the invention, there is provided a method of manufacturing extra-low-oxygen copper comprising: melting a copper raw material to produce a molten copper, deoxidizing the molten copper, maintaining the molten copper in a molten state in contact with graphite, during the deoxidizing, and adding a copper oxide in an amount sufficient to achieve an oxygen concentration within a range of from 50 to 200 ppm, relative to the molten copper, during a portion of the deoxidizing.

According to yet another feature of the invention, there is provided an extra-low-oxygen copper having an oxygen concentration of no more than 0.5 ppm.

According to another feature of the invention, there is provided a method of manufacturing extra-low-oxygen copper comprising: melting a copper raw material while contacting the copper raw material with graphite to produce a molten copper, deoxidizing the molten copper, maintaining the molten copper in a molten state in contact with graphite, during the deoxidizing, blowing one of an inert gas and a reducing gas into the molten copper, during the deoxidizing, as soon as the molten copper reaches 1200° C., blowing a copper oxide into the molten copper with the one of an inert gas and a reducing gas, and the step of adding including adding an amount of the copper oxide sufficient to produce an oxygen concentration within a range of from 50 to 200 ppm, relative to the molten copper, for a portion of the deoxidizing.

The above, and other objects, features and advantages of the present invention will become apparent from the detailed description.

DETAILED DESCRIPTION OF THE PREFERRED EMBODIMENTS

The present invention provides a method of manufacturing an extra-low-oxygen copper, which permits reduction of the oxygen concentration to below 0.5 ppm by adding copper oxide during a portion of any of the following processes, to achieve a 50–200 ppm oxygen concentration relative to molten copper:

(1) deoxidation in which the molten raw material copper is in the presence of graphite;

(2) deoxidizing while blowing a reducing gas into molten raw material copper; and (3) melting raw copper in the presence of graphite and deoxidizing the melting raw material copper while blowing an inert gas or a reducing gas into the molten copper in the presence of graphite.

When the copper oxide, added to one of the above processes, contains less than 50 ppm oxygen, relative to molten copper, the deoxidizing effect is not sufficient. A large amount of oxygen of over 200 ppm in the copper oxide, relative to molten copper, is also undesirable, since the excessively high oxygen concentration results in oxygen remaining in the molten copper. Thus, the copper oxide added to one of the above deoxidation processes should be limited to copper oxide having an oxygen concentration, relative to molten copper, within a range of from 50 to 200 ppm.

The copper oxide used in the present invention is preferably CuO or $Cu_2O$, but a copper oxide of any other compound form may be employed, such as indicated by $Cu_xO$. The inert gas used in the present invention is preferably an argon gas or nitrogen gas, but is not limited to these gases. The reducing gas used in the present invention is preferably a carbon monoxide gas, but is not limited to this type of gas.

In Example 1, samples of the invention Nos. 1 to 20 and comparative samples Nos. 1 to 12 were prepared using electrolytic copper having an oxygen concentration of 20 ppm as the raw material. First, 15 kg of electrolytic copper was placed in a graphite crucible. Then, the electrolytic copper was melted in an argon gas atmosphere. Next, a gas was blown for ten minutes through a graphite nozzle or an alumina nozzle into the molten copper at the flow rates shown in Tables 1-3 as soon as the molten copper temperature reached 1,200° C. Simultaneously, $Cu_xO$ powder was blown with the blown gas, in the amounts shown in Tables 1-3. The above deoxidation process was continued by blowing gas into the molten copper for another ten minutes, without $Cu_xO$ powder, while stirring the molten copper. Finally, the molten copper was cast into a mold.

As shown in Table 1, sample of the invention No. 1 used CO as the blown gas. The gas was blown at a flow rate of 51/min. The nozzle, which the gas was blown through, was made of graphite. The amount of $Cu_xO$ added with the blown gas was 3.7 g. When the $Cu_xO$ powder was added it caused an oxygen concentration of 50 ppm, relative to the molten copper. The deoxidized copper casting produced by sample of the invention No. 1 contained an oxygen concentration of 0.2 ppm.

For comparison purposes, conventional samples Nos. 1 to 6 were prepared, without adding $Cu_xO$ powder as described above. Deoxidation was carried out by blowing a gas into molten copper through a graphite nozzle or an alumina nozzle at the flow rates shown in Table 3. Then, the molten copper was cast into a mold.

The concentration of oxygen contained in the deoxidized copper castings obtained from the samples of the invention Nos. 1 to 18, the comparative samples Nos. 1 to 12, and the conventional samples Nos. 1 to 6 was measured, and the results are shown in Tables 1-3.

In Example 2 samples of the invention Nos. 21-31 and comparative samples Nos. 13 to 20 were prepared using electrolytic copper having an oxygen concentration of 15 ppm as the raw material. First, 15 kg of the electrolytic copper was placed in a graphite crucible. Then, the electrolytic copper was melted in a CO gas atmosphere. As soon as the temperature of the molten copper reached 1200° C., a gas was blown for twenty minutes through a graphite nozzle or an alumina nozzle into the molten copper at the flow rates shown in Tables 4-5. Simultaneously, $Cu_xO$ powder was blown through the nozzle used above, with the blown gas, in the amounts shown in Tables 4-5. The process of deoxidation continued by blowing the gas, as above, for another ten minutes, without $Cu_xO$ powder. Finally, the molten copper was cast into a mold to form a casting.

For comparison purposes, conventional samples Nos. 7 to 9 were prepared, without blowing $Cu_xO$ powder as described above, by blowing a gas into molten copper at a flow rate shown in Table 5 through a graphite nozzle or an alumina nozzle for deoxidation. Then, the molten copper was cast into a mold to form a casting.

The oxygen content in each of the deoxidized castings made from the samples of the invention Nos. 21 and 31, the comparative samples Nos. 13 to 20, and the conventional samples Nos. 7 to 9 was measured, and the results are shown in Tables 4-5.

In Example 3, samples of the invention Nos. 32 to 36 and comparative samples Nos. 21 and 22 were prepared by using electrolytic copper having an oxygen concentration of 12 ppm as the raw material. First, 15 kg of electrolytic copper was melted in a graphite crucible. The molten copper was kept in the graphite crucible at 1,200° C. for 15 minutes. Then, $Cu_xO$ powder was added in an amount shown in Table 6. The molten copper was kept in the graphite crucible at 1,200° C. for another 15 minutes. Finally, the molten copper was cast into a mold to form a casting.

For comparison purposes, a conventional sample No. 10 was prepared, without adding $Cu_xO$, by melting the above-mentioned electrolytic copper in the graphite crucible in the same manner as above.

In Example 4, samples of the invention Nos. 37 to 41 and comparative samples Nos. 23 and 24 were prepared by using electrolytic copper having an oxygen concentration of 10 ppm. First, 15 kg of the electrolytic copper was melted in an alumina crucible. As soon as the molten copper temperature reached 1,200° C. a graphite bar was immersed into the molten copper. The temperature of the molten copper was maintained at 1,200° C. for 15 minutes. Then $Cu_xO$ powder was added in an amount shown in Table 7. Next, after maintaining the temperature of the molten copper at 1,200° C. for another 15 minutes, the molten copper was cast into a mold to form castings.

For comparison purposes, a conventional sample No. 1 was prepared, without adding $Cu_xO$ powder, by melting the electrolytic copper in the same manner as above.

In Example 5, copper obtained by the method of the present invention, having an oxygen concentration of up to 0.5 ppm, was used. The casting of this copper was baked at a temperature of 550° C. for one hour. The outgassing rate of the casting was measured after maintaining it at a temperature of 500° C. for 30 minutes. For comparison purposes, the outgassing rate was measured for conventional low-oxygen copper having an oxygen concentration of 1 to 2 ppm. The results of measuring Nos. 1 to 3 of the present invention and Nos. 1, 2 and 7 of conventional samples are shown in Table 8.

The results of Examples 1 to 4, shown in Tables 1-7, indicates that it is impossible to reduce the oxygen concentration in the oxygen-free copper below 0.5 ppm in any of conventional samples Nos. 1 to 11, without adding copper oxide. However, the results indicate it is possible to reduce the oxygen concentration to below 0.5 ppm in all the samples of the invention by adding copper oxide during a portion of a period of deoxidation. Thus, it is possible to obtain extra-low-oxygen copper using the method of the present invention.

The final result of the present invention is surprising, and beyond intuition, in that adding $Cu_xO$ to a molten copper would result in a final copper casting having an extra-low concentration of oxygen.

The results in Tables 1-7 also show that when the amount of copper oxide added during deoxidation contains an amount of oxygen under 50 ppm or over 200 ppm, as observed in the comparative samples Nos. 1 to 24, it is impossible to reduce the oxygen concentration, in the final copper casting, below 0.5 ppm. In Tables 1-7, values outside the range of oxygen concentration of from 50 to 200 ppm, relative to molten copper of the added copper oxide, are marked with "*".

According to the method of the present invention, as described above, it is possible to manufacture an extra-low-oxygen copper having an oxygen concentration much lower than that in the conventional oxygen-free copper. Thus, because of the low oxygen concentration, any hydrogen gas present in the material can be easily removed by baking. Accordingly, the present invention provides a valuable method of obtaining extra-low-oxygen copper, since it provides a material for a vacuum vessel which never reduces the degree of vacuum of the vacuum vessel when used under vacuum.

Having described preferred embodiments of the invention, it is to be understood that the invention is not limited to those precise embodiments, and that various changes and modifications may be effected therein by one skilled in the art without departing from the scope or spirit of the invention as defined in the appended claims.

TABLE 1

| Division | | Crucible material | Blown gas: Kind of gas | Blown gas: Flow rate (l/min) | Nozzle material | Amount of added CuO (g) | Amount of $O_2$ relative to molten copper (ppm) | $O_2$ concentration in deoxidized copper casting (ppm) |
|---|---|---|---|---|---|---|---|---|
| Sample of the invention | 1 | Graphite | CO | 5 | Graphite | 3.7 | 50 | 0.2 |
| | 2 | | CO | 5 | Graphite | 7.5 | 100 | <0.1 |
| | 3 | | CO | 7 | Graphite | 15 | 200 | 0.3 |
| | 4 | | Ar | 5 | Graphite | 3.7 | 50 | 0.3 |
| | 5 | | Ar | 5 | Graphite | 7.5 | 100 | 0.4 |
| | 6 | | Ar | 7 | Graphite | 15 | 200 | 0.4 |
| | 7 | | $N_2$ | 6 | Graphite | 3.7 | 50 | 0.3 |
| | 8 | | $N_2$ | 5 | Graphite | 7.5 | 100 | 0.2 |
| | 9 | | $N_2$ | 6 | Graphite | 15 | 200 | 0.4 |
| | 10 | | CO | 7 | Alumina | 5.2 | 70 | 0.2 |
| | 11 | | CO | 5 | Alumina | 8.2 | 110 | 0.1 |
| | 12 | | CO | 5 | Alumina | 10.4 | 140 | 0.2 |
| | 13 | | CO | 5 | Graphite | *13.4 | 100 | 0.2 |
| | 14 | | CO | 5 | Graphite | *26.8 | 200 | 0.1 |

*: Added with $Cu_2O$

TABLE 2

| Division | | Crucible material | Blown gas: Kind of gas | Blown gas: Flow rate (l/min) | Nozzle material | Amount of added CuO (g) | Amount of $O_2$ relative to molten copper (ppm) | $O_2$ concentration in deoxidized copper casting (ppm) |
|---|---|---|---|---|---|---|---|---|
| Sample of the invention | 15 | Graphite | Ar | 5 | Alumina | 4.5 | 60 | 0.4 |
| | 16 | | Ar | 5 | Alumina | 6.7 | 90 | 0.4 |
| | 17 | | Ar | 5 | Alumina | 9.7 | 130 | 0.3 |
| | 18 | | $N_2$ | 5 | Alumina | 6.0 | 80 | 0.3 |
| | 19 | | $N_2$ | 5 | Alumina | 9.0 | 120 | 0.4 |
| | 20 | | $N_2$ | 5 | Alumina | 13.4 | 180 | 0.3 |
| Comparative sample | 1 | | CO | 5 | Graphite | 2.2 | 30* | 0.8 |
| | 2 | | CO | 7 | Graphite | 18.6 | 250* | 1.4 |
| | 3 | | CO | 5 | Alumina | 3.0 | 40* | 0.9 |
| | 4 | | CO | 5 | Alumina | 15.6 | 210* | 1.0 |
| | 5 | | Ar | 5 | Graphite | 2.2 | 30* | 1.5 |
| | 6 | | Ar | 6 | Graphite | 16.4 | 220* | 1.2 |

(*values outside the scope of the present invention)

TABLE 3

| Division | | Crucible material | Blown gas: Kind of gas | Blown gas: Flow rate (l/min) | Nozzle material | Amount of added CuO (g) | Amount of $O_2$ relative to molten copper (ppm) | $O_2$ concentration in deoxidized copper casting (ppm) |
|---|---|---|---|---|---|---|---|---|
| Comparative Sample | 7 | Graphite | Ar | 5 | Alumina | 3.0 | 40* | 0.9 |
| | 8 | | Ar | 5 | Alumina | 16.0 | 215* | 0.9 |
| | 9 | | $N_2$ | 5 | Graphite | 3.3 | 45* | 0.9 |
| | 10 | | $N_2$ | 6 | Graphite | 16.0 | 215* | 1.8 |
| | 11 | | $N_2$ | 5 | Alumina | 3.0 | 40* | 0.9 |
| | 12 | | $N_2$ | 5 | Alumina | 15.7 | 210* | 1.3 |
| Conventional sample | 1 | | CO | 5 | Alumina | — | — | 1.0 |
| | 2 | | CO | 5 | Graphite | — | — | 1.2 |
| | 3 | | Ar | 5 | Alumina | — | — | 1.6 |
| | 4 | | Ar | 5 | Graphite | — | — | 1.0 |
| | 5 | | $N_2$ | 6 | Alumina | — | — | 1.4 |
| | 6 | | $N_2$ | 8 | Graphite | — | — | 0.9 |

(*values outside the scope of the present invention)

TABLE 4

| Division | | Crucible material | Brawn gas: Kind of gas | Brawn gas: Flow rate (l/min) | Nozzle material | Amount of added CuO (g) | Amount of $O_2$ relative to molten copper (ppm) | $O_2$ concentration in deoxidized copper casting (ppm) |
|---|---|---|---|---|---|---|---|---|
| Sample of the invention | 21 | Alumina | CO | 5 | Graphite | 3.7 | 50 | 0.4 |
| | 22 | | CO | 6 | Graphite | 7.5 | 100 | 0.3 |
| | 23 | | CO | 6 | Graphite | 15 | 200 | 0.5 |
| | 24 | | Ar | 5 | Graphite | 3.7 | 50 | 0.4 |
| | 25 | | Ar | 5 | Graphite | 7.5 | 100 | 0.4 |
| | 26 | | Ar | 5 | Graphite | 13.4 | 180 | 0.5 |
| | 27 | | $N_2$ | 7 | Graphite | 4.5 | 60 | 0.4 |
| | 28 | | $N_2$ | 5 | Graphite | 7.5 | 100 | 0.3 |
| | 29 | | $N_2$ | 5 | Graphite | 15 | 200 | 0.5 |
| | 30 | | CO | 6 | Alumina | 3.7 | 50 | 0.4 |
| | 31 | | CO | 5 | Alumina | 8.0 | 120 | 0.3 |

TABLE 5

| Division | | Crucible material | Blown gas: Kind of gas | Blown gas: Flow rate (l/min) | Nozzle material | Amount of added CuO (g) | Amount of $O_2$ relative to molten copper (ppm) | $O_2$ concentration in deoxidized copper casting (ppm) |
|---|---|---|---|---|---|---|---|---|
| Comparative sample | 13 | Alumina | Co | 5 | Graphite | 3.0 | 40* | 0.9 |
| | 14 | | Co | 5 | Graphite | 18.6 | 250* | 1.5 |
| | 15 | | Ar | 6 | Graphite | 2.2 | 30* | 0.9 |
| | 16 | | Ar | 5 | Graphite | 16.4 | 220* | 1.4 |
| | 17 | | $N_2$ | 5 | Graphite | 2.6 | 35* | 1.0 |
| | 18 | | $N_2$ | 7 | Graphite | 18.8 | 250* | 1.6 |
| | 19 | | CO | 5 | Alumina | 1.9 | 25* | 1.2 |
| | 20 | | CO | 7 | Alumina | 15.7 | 210* | 1.6 |
| Conventional sample | 7 | | CO | 5 | Graphite | — | — | 2.0 |
| | 8 | | CO | 5 | Alumina | — | — | 1.5 |
| | 9 | | Ar | 5 | Graphite | — | — | 2.1 |

(*values outside the scope of the present invention)

TABLE 6

| Division | | Crucible Material | Amount of added CuO (g) | Amount of $O_2$ relative to molten copper (ppm) | $O_2$ concentration in deoxidized copper casting (ppm) |
|---|---|---|---|---|---|
| Sample of the invention | 32 | Graphite | 3.7 | 50 | 0.4 |
| | 33 | | 7.5 | 100 | 0.3 |
| | 34 | | 15 | 200 | 0.5 |
| | 35 | | 5.6 | 75 | 0.4 |
| | 36 | | 9.7 | 130 | 0.5 |
| Comparative sample | 21 | | 2.2 | 30* | 0.9 |
| | 22 | | 18.6 | 250* | 2.0 |
| Conventional sample | 10 | | — | — | 0.9 |

(*values outside the scope of the present invention)

TABLE 7

| Division | | Crucible Material | Amount of added CuO (g) | Amount of $O_2$ relative to molten copper (ppm) | $O_2$ concentration in deoxidized copper casting (ppm) |
|---|---|---|---|---|---|
| Sample of the invention | 37 | Alumina | 3.7 | 50 | 0.5 |
| | 38 | | 7.5 | 100 | 0.4 |
| | 39 | | 15.0 | 200 | 0.5 |
| | 40 | | 6.0 | 80 | 0.3 |
| | 41 | | 97 | 130 | 0.5 |
| Comparative sample | 23 | | 30 | 40* | 0.8 |
| | 24 | | 17.1 | 230* | 1.5 |
| Conventional sample | 11 | | — | — | 1.2 |

TABLE 7-continued

| Division | Crucible Material | Amount of added CuO (g) | Amount of $O_2$ relative to molten copper (ppm) | $O_2$ concentration in deoxidized copper casting (ppm) |
|---|---|---|---|---|
| tional sample | | | | |

(*values outside the scope of the present invention)

TABLE 8

| Division | | Oxygen concentration of copper (ppm) | Baking conditions: Temperature (°C.) | Baking conditions: Time (hr) | Outgassing rate (Torr · l/sec · cm²) |
|---|---|---|---|---|---|
| Sample of the invention | 1 | 0.2 | 550 | 1 | $3 \times 10^{-11}$ |
| | 2 | <0.1 | 550 | 1 | $1 \times 10^{-11}$ |
| | 3 | 0.3 | 550 | 1 | $5 \times 10^{-11}$ |
| Conventional sample | 1 | 1.0 | 550 | 1 | $1 \times 10^{-9}$ |
| | 2 | 1.2 | 550 | 1 | $1 \times 10^{-9}$ |
| | 7 | 2.0 | 550 | 1 | $2 \times 10^{-9}$ |

What is claimed is:

1. A method of processing copper comprising:

deoxidizing a molten copper;

adding a $Cu_xO$ to said molten copper to produce a mixture;

said $Cu_xO$ producing an oxygen concentration within a range of from 50 to 200 ppm relative to said molten copper for a portion of said deoxidizing; and maintaining said mixture at a predetermined melting temperature for a predetermined time.

2. A method according to claim 1, wherein said predetermined melting temperature is 1200° C.

3. A method according to claim 1, wherein said predetermined time is 15 minutes.

4. A method according to claim 1, wherein the step of deoxidizing includes blowing one of an inert gas and a reducing gas into said molten copper.

5. A method according to claim 4, wherein the step of adding said $Cu_xO$ includes blowing a copper oxide into said molten copper with blowing said one of an inert gas and a reducing gas.

6. A method of processing copper comprising:

melting a copper raw material into a molten copper;

deoxidizing said copper raw material; and the step of deoxidizing including creating an oxygen concentration within a range of from 50 to 200 ppm relative to said molten copper during a portion of said deoxidizing.

7. A method of processing copper comprising:

melting a copper raw material to produce a molten copper;

deoxidizing said molten copper;

maintaining said molten copper in a molten state in contact with graphite, during said deoxidizing: and adding a $Cu_xO$ in an amount sufficient to achieve an oxygen concentration within a range of from 50 to 200 ppm, relative to said molten copper, during a portion of said deoxidizing.

8. A method according to claim 7, wherein said melting of said copper raw material includes contacting said copper raw material with graphite.

9. A method according to claim 7, wherein:

said deoxidizing includes blowing a reducing gas into said molten copper and stirring said molten copper.

10. A method according to claim 7, wherein said $Cu_xO$ is selected from the group consisting of CuO and $Cu_2O$.

11. A method according to claim 7, wherein said adding of said $Cu_xO$ occurs when said molten copper is 1200° C.

12. An extra-low-oxygen copper having an oxygen concentration of no more than 0.5 ppm produced in accordance with the method of claim 7.

13. A method according to claim 8, wherein:

said deoxidizing includes blowing an inert gas into said molten copper and stirring said molten copper while contacting said molten copper with graphite.

14. A method according to claim 13, wherein said inert gas is selected from the group consisting of argon and nitrogen.

15. A method according to claim 8, wherein:

said deoxidizing includes blowing a reducing gas into said molten copper and stirring said molten copper while contacting said molten copper with graphite.

16. A method according to claim 15, wherein said reducing gas is carbon monoxide.

17. A method of processing copper comprising:

melting a copper raw material while contacing said copper raw material with graphite to produce a molten copper;

deoxidizing said molten copper;

maintaining said molten copper in a molten state in contact with graphite, during said deoxidizing;

blowing one of an inert gas and a reducing gas into said molten copper, during said deoxidizing;

blowing a $Cu_xO$ into said multen copper with said one of an inert gas and a reducing gas; and the step of blowing a $Cu_xO$ including blowing an amount of said $Cu_xO$ sufficient to produce an oxygen concentration within a range of from 50 to 200 ppm, relative to said molten copper, for a portion of said deoxidizing.

18. A method of manufacturing extra-low-oxygen copper comprising:

melting a copper raw material while contacting said copper raw material with graphite to produce a molten copper;

deoxidizing said molten copper;

maintaining said molten copper in a molten state in contact with graphite, during said deoxidizing;

blowing one of an inert gas and a reducing gas into said molten copper, during said deoxidizing, as soon as said molten copper reaches 1200° C.;

blowing a $Cu_xO$ into said molten copper with said one of an inert gas and a reducing gas; and the step of blowing a $Cu_xO$ including blowing an amount of said $Cu_xO$ sufficient to produce an oxygen concentration within a range of from 50 to 200 ppm, relative to said molten copper, for a portion of said deoxidizing.

* * * * *